US007659469B2

(12) United States Patent
Belli

(10) Patent No.: US 7,659,469 B2
(45) Date of Patent: Feb. 9, 2010

(54) PITCH MODULATOR DRUM

(75) Inventor: Remo D. Belli, Sherman Oaks, CA (US)

(73) Assignee: Remo, Inc., Valencia, CA (US)

( * ) Notice: Subject to any disclaimer, the term of this patent is extended or adjusted under 35 U.S.C. 154(b) by 0 days.

(21) Appl. No.: 11/541,143

(22) Filed: Oct. 2, 2006

(65) Prior Publication Data

US 2008/0078279 A1 Apr. 3, 2008

(51) Int. Cl.
*G10D 13/02* (2006.01)

(52) U.S. Cl. ..... 84/411 R

(58) Field of Classification Search ..... 84/411 R, 84/421, 411 A, 411 M, 419
See application file for complete search history.

(56) References Cited

U.S. PATENT DOCUMENTS 5,606,142 A * 2/1997 Volpp ..... 84/411 R

* cited by examiner

*Primary Examiner*—Kimberly R Lockett
(74) *Attorney, Agent, or Firm*—Larry F. Gitlin

(57) ABSTRACT

A drum with a vibrating membrane for producing sounds in a range of low to high resonant frequencies including a drum shell with a first open end and a second open end, a drumhead, including a vibrating membrane, covering said first open end, a cover with a threaded opening extending across and secured to said second end, and a resonant member having a first end and a second end, with the first end having a threaded means for detachable coupling with the threaded opening in the cap in airtight relation to enhance and manipulate the low resonant frequencies independent of the high resonant frequencies upon the striking of the membrane.

14 Claims, 14 Drawing Sheets

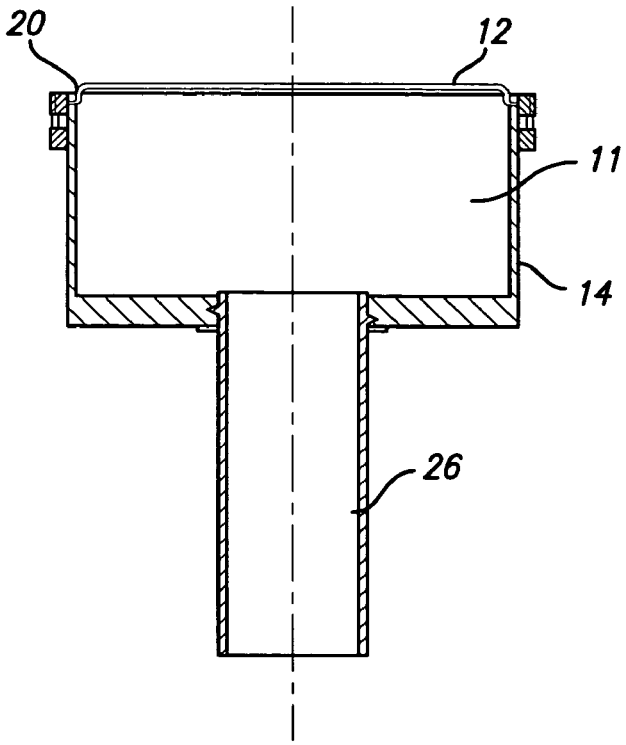
FIG. 5
FIG. 6
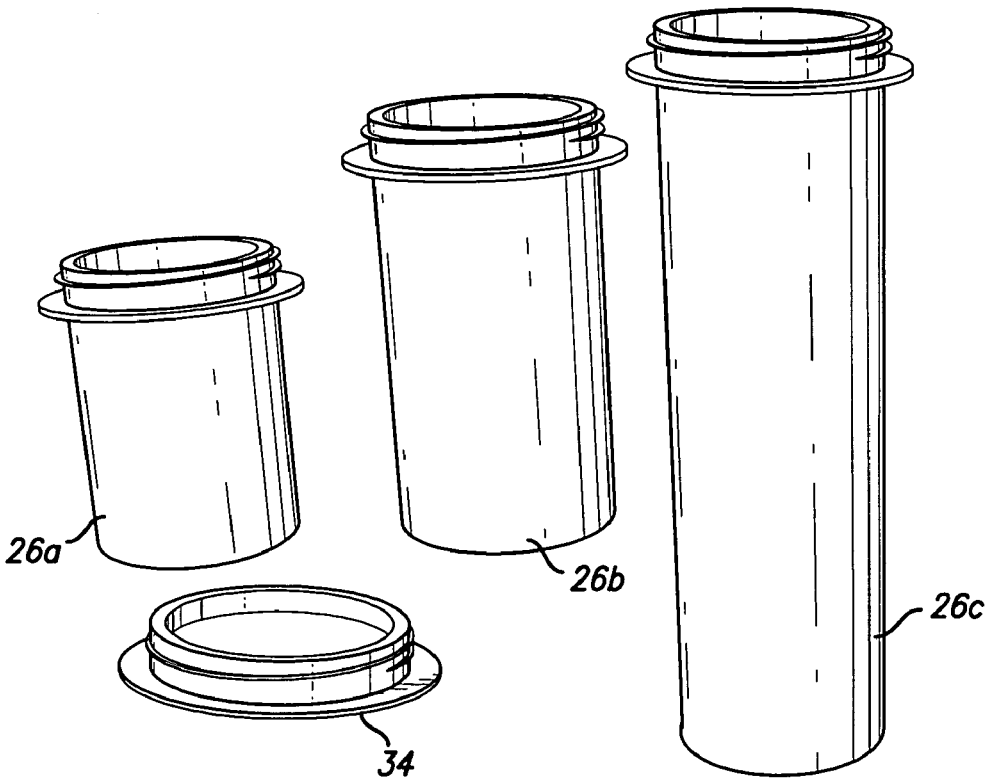

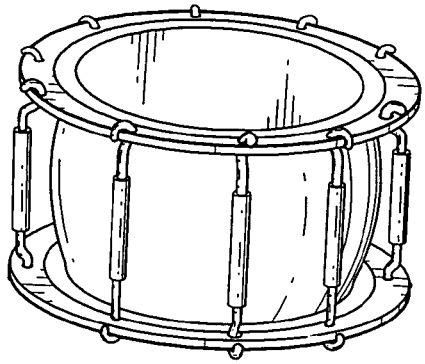
FIG. 8D
FIG. 9
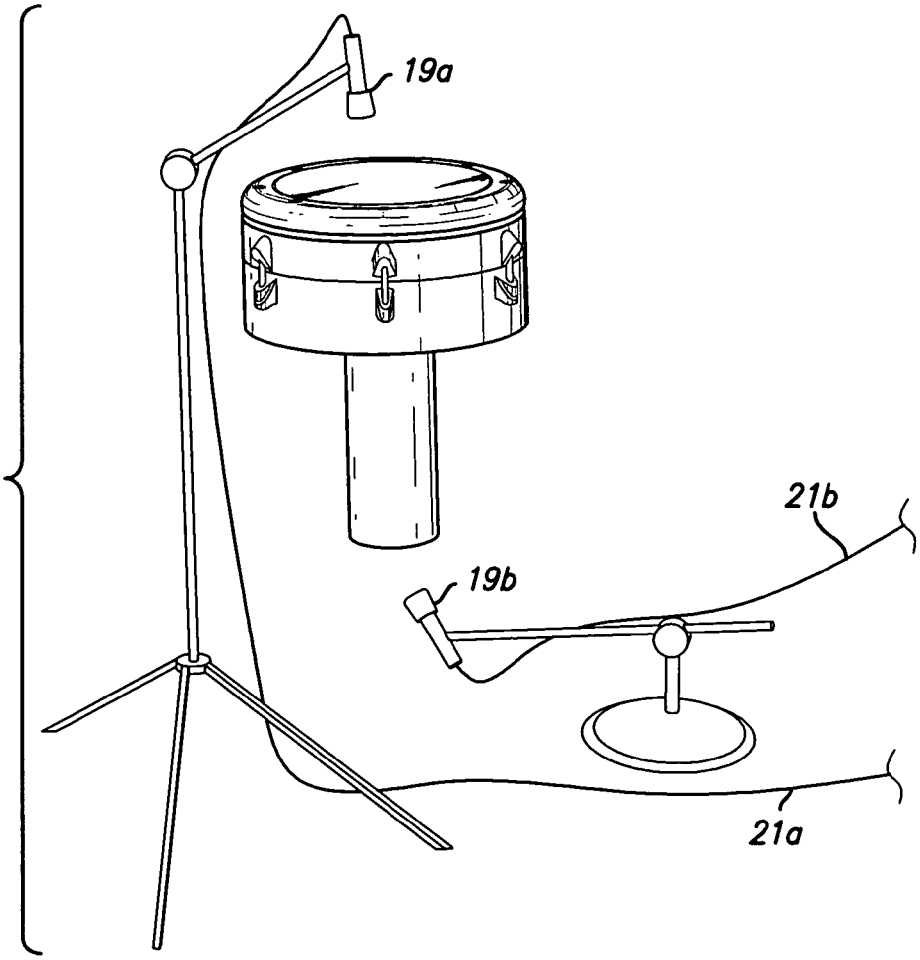

PITCH MODULATOR DRUM

BACKGROUND OF THE INVENTION

1. Field of the Invention

The present invention relates generally to the field of musical drums, and more particularly to an improvement of a drum that enables modulation of the high and low pitches of the drum sounds to accurately simulate the authentic sounds of a variety of well-known ethnic and other types of drums.

2. Description of the Prior Art.

Musical drums have a rich and varied history. The shell portion of the drum comes in all shapes and sizes and has been fashioned from a variety of materials, including wood, fibrous material, metal and the like. Drumheads are typically made from animal skins or a synthetic substitute.

In the prior art, the sounds that drums produce will vary depending on a number of factors, including, without limitation, the size of the drum, the material composition of the shell, the material composition of the drumhead and the tautness of the head. All these factors can have a substantial affect on the tones and pitches and specifically the unique characteristics of the sounds that the drums produce. Once in place, the effect of any of these factors tend not to vary. Thus, a shell made of a certain kind of material will affect the tone or pitch produced by the drum due to the unique characteristics of that particular material. As long as that particular material composition remains intact, i.e., does not decay for any reason, or does not contain a defect, the contribution that the material makes to the drum sound will remain relatively constant. The same is true of the drumhead material, which also embodies its own unique characteristics. As long as the drumhead material remains relatively intact and the head maintained at a constant tautness, the effect that the drumhead has on the drum sounds and its unique sound characteristics will also remain relatively constant.

However, absent from the prior art is the means and structure to provide a drum system that is capable of producing a variety of unique drum sounds using a single instrument modified only by an interchangeable component. More specifically, this includes a unique resonating drum system that produces vibrations at a certain frequency (particularly bass tones) to simulate authentic drum sounds, including, for example, sounds produced by the African Djembe, the Middle Eastern Doumbek, the Japanese Shime Daiko and the Afro-Cuban Conga.

Many goblet and waisted style drums, such as the Doumbeks and Djembes, use what is known as the Helmholtz resonance system based on a resonator, which comprises a container or cavity with an open hole or neck.

The Helmholtz resonator is an example of an acoustic system which is useful when the desired wavelength is significantly larger than the physical dimensions of the system. Other familiar examples of Helmholtz resonators include blowing across the top of an empty bottle. Goblet and bowl shaped drums essentially work in the same manner as the empty bottle except the air is set in motion (in and out of the cavity and neck) by striking the drumhead instead of blowing air across the neck. Bowl or cavity shaped drums of the types described produce two pronounced sounds-high and low. High harmonics generally are enunciated from the drumhead itself and largely depend on how tight or taut the drumhead is. These higher pitched sounds radiate up and around from the drumhead. The bass tones emanate from the bottom of the drum and are produced by the "Helmholtz" resonator or cavity of the drum in conjunction with the neck. Resonant frequencies are determined by the radius of the neck, area of the neck, and length of the neck in conjunction with the speed of sound. The smaller neck diameter lowers the pitch or resonant frequency. However, there is no means to change the resonant frequency of these drums except by placing one's hand or arm up and inside the body to effectively lower the pitch. This technique obviously has its limitations. This unique resonance system is apparent in drums such as a small diameter (8") Doumbek drum where a very low frequency is produced. There are no low resonant frequencies present when the drum is sitting on the floor, as it creates a "stopper" and does not allow the air to escape out and back through the neck or body. Certain drums are intentionally made closed so that no air can escape with the movement of the drumhead, such as a Japanese Shime Daiko drum or Japanese Hira Daiko Drum. Conga drums are sometimes played sitting flat on the floor thereby creating a "stopper" and eliminating the bass from the instrument.

The drum system of the present invention uses a unique and significantly improved resonating drum system consisting of a drum body in a rigid structure communicating by a removable threaded narrow neck (modulator tube) to the outside air. The frequency of resonance is determined by the volume of air, in and near the neck, resonating in conjunction with the compliance of the air in the cavity. The sustained bass tone is due to the 'springiness' of air: when you compress it, its pressure increases and it tends to expand back to its original volume.

In accordance with the present invention, musical drums with interchangeable resonant tubes, called "modulators" or "pitch modulators", which vary in diameter and/or shape, effectively create long lasting and varying resonant bass tones. Each of these interchangeable components will produce a unique resonant frequency, independent of drumhead tension. The "stopper" sound described above is easily achieved by removing the threaded modulator tube and replacing it with the threaded plug.

Thus, the present invention comprises a single lightweight, portable, musical drum that is able to produce the unique characteristic sounds of a Conga, Djembe, Doumbek, and Shime Daiko drum simply with the use of detachably and interchangeably connecting changing the tubes or similarly-shaped structures and a "stopper" plug.

BRIEF DESCRIPTION OF THE DRAWINGS

FIG. 5 is a cross-sectional view of the embodiment of the present invention shown in perspective in FIG. 18.

FIG. 6 shows an assortment of pitch modulator tube and plug components that are employed in accordance with the present invention.

FIG. 8D is a perspective view of a prior art musical instrument comprising a Japanese Shime Daiko.

FIG. 9 depicts a microphone placement relative to an embodiment of the present invention to receive and detect bass (low) and high pitch tones from a drum for conversion to a visual representation on a sound chart, such as those in FIGS. 10-15.

DETAILED DESCRIPTION OF THE PREFERRED EMBODIMENT

Figure 1:
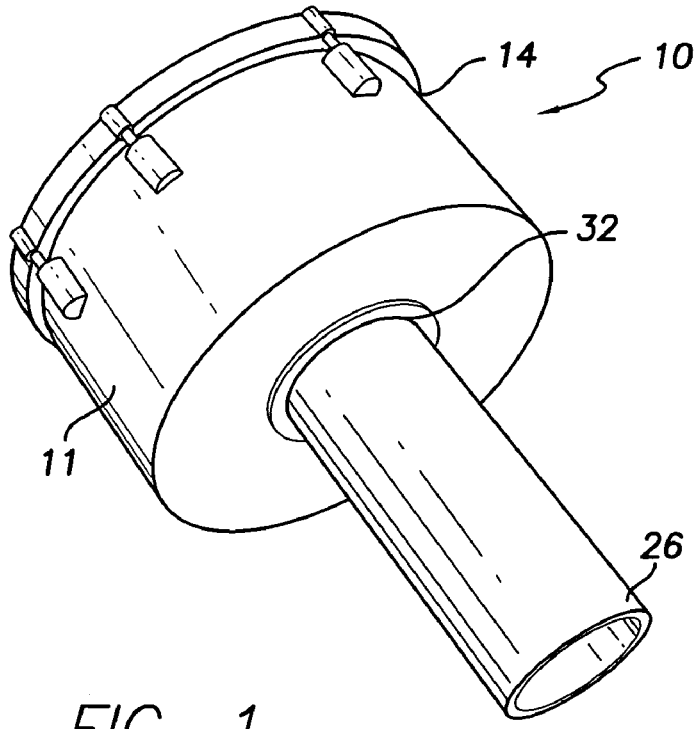
FIG. 1 is a perspective view of a specific embodiment of the present invention.
Figure 2:
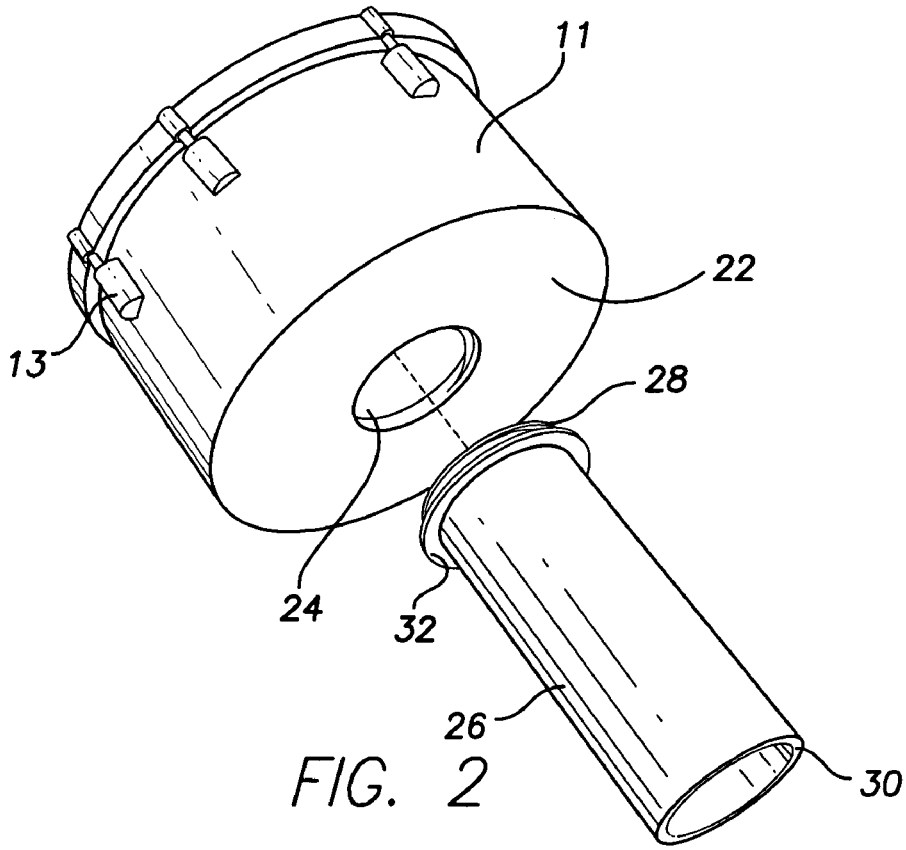
FIG. 2 is a perspective view of an embodiment of the present invention showing the details of a threaded attachment.
Figure 3:
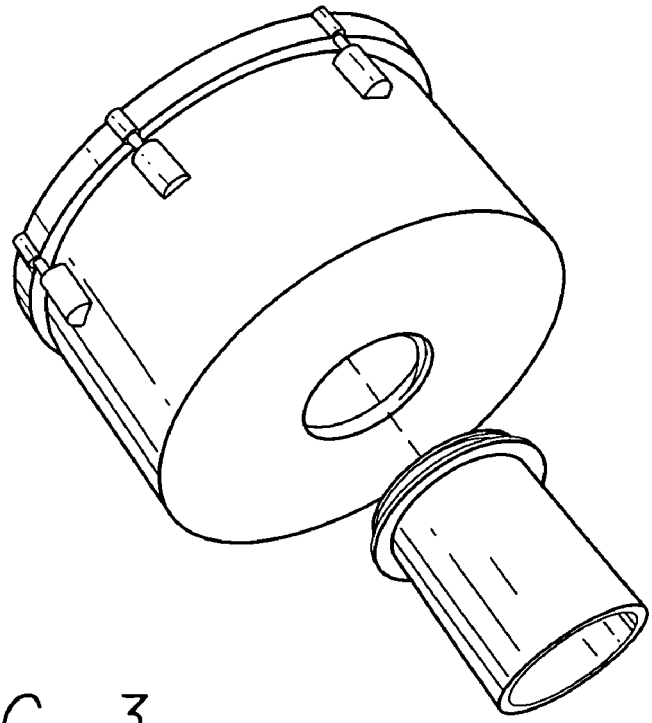
FIG. 3 is a perspective view of another embodiment of the present invention showing the details of a threaded attachment.

FIG. 1 illustrates one of several preferred embodiments of the pitch modulator drum 10 of the present invention. Drum 10 comprises a drum body 11, a vibrating membrane 12 for producing sounds in a range of low to high resonant frequencies, drumshell 14, which includes first open end 16 and second open end 18, drumhead 20, which includes membrane 12 and counterhoop 13 and covers first open end 16, drum lugs 15 and a cover 22, which includes a threaded opening 24, extending across and secured to second open end 18. Also provided is a resonant member 26 having a threaded first end 28 and a second end 30. Threaded first end 28 is provided for detachable coupling with threaded opening 24 in airtight relation to enhance and manipulate low resonant (or bass) frequencies independent of high pitched frequencies when the membrane is struck.

Figure 4:
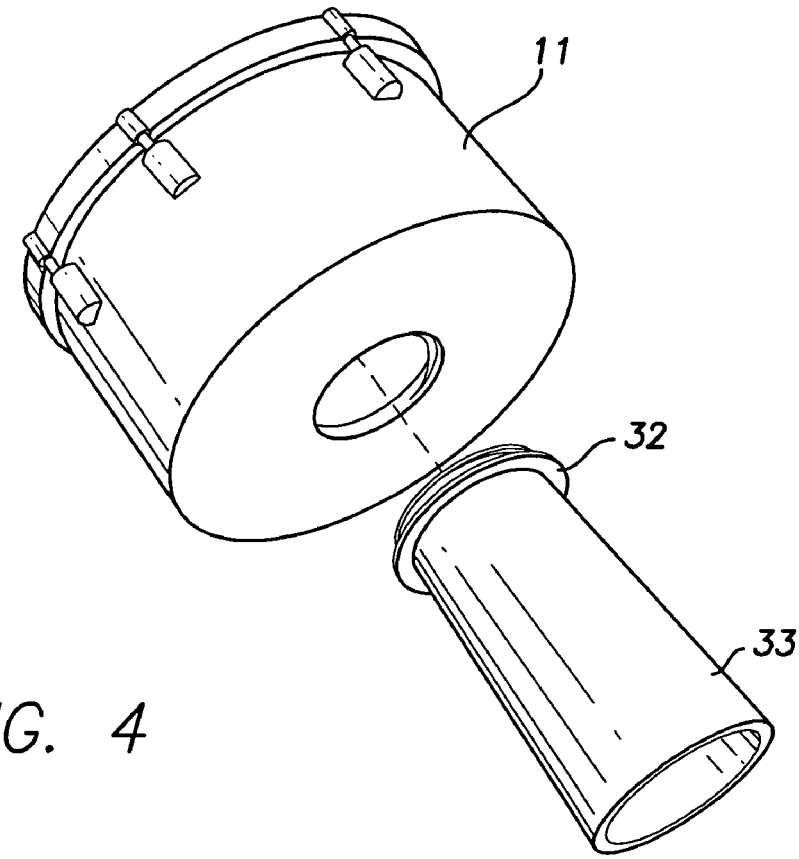
FIG. 4 is a perspective view of another embodiment of the present invention showing the details of a threaded attachment.

Resonant member 26 may be configured in a variety of shapes and sizes, including 6, 8 and 14 inch tubes (FIG. 6) 26*a*, 26*b* and 26*c*, respectively, ranging from 2 to 4 inches (or more) in diameter and conical configured structures, such as the one shown in FIG. 4 as resonant member 33. Also shown in FIG. 6 is stopper 34, which when installed, virtually eliminates most, if not all, bass tones.

In order to ensure that first threaded end 28 is securely attached to mated threaded opening 24 in airtight relation, flange member 32 is provided to seal the connection.

Figure 7:
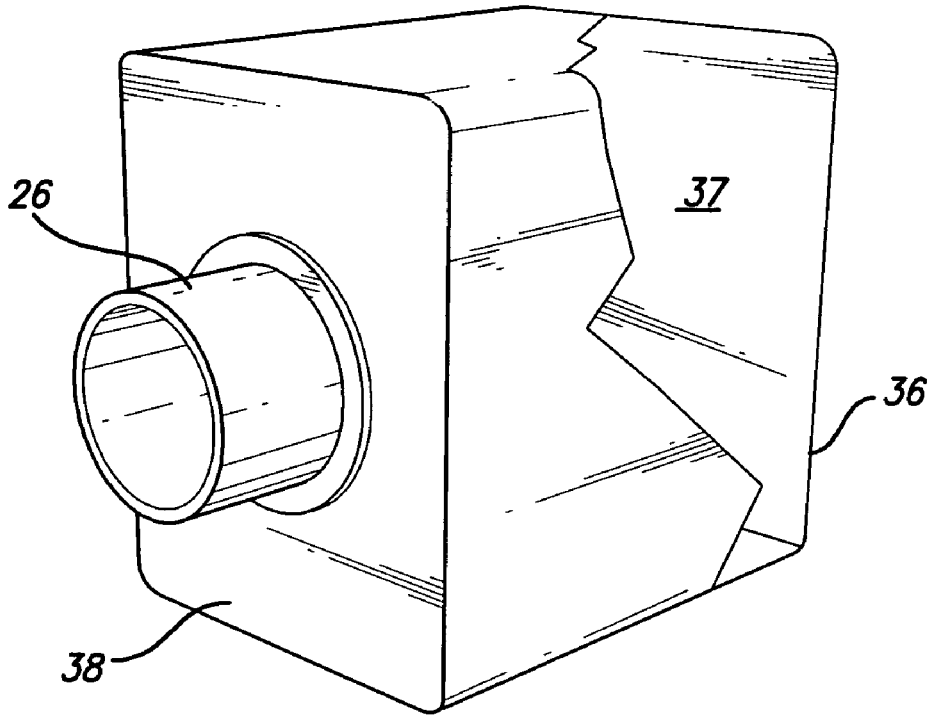
FIG. 7 is a perspective view of another embodiment of the present invention.

FIG. 7 illustrates a Cajon drum 36, which is box-like in configuration, and includes resonant member 26 extending from wall 38 wherein the connection is sealingly airtight. The Cajon box has one large opening to produce a single bass sound when the thin wooden membrane 37 is struck. The Bass note can be lowered and the length of note can be increased in Cajon drum 36 with the employment of various length modulator tubes, such as tubes 26*a*, 26*b* and 26*c*.

FIGS. 10 through 15 provide a visual representation (converted from the signals received through microphones 19*a*, 19*b* and transmitted through wires 21*a* and 21*b*) showing the enhancement of the bass frequencies as various resonant members 26.

Figure 10:
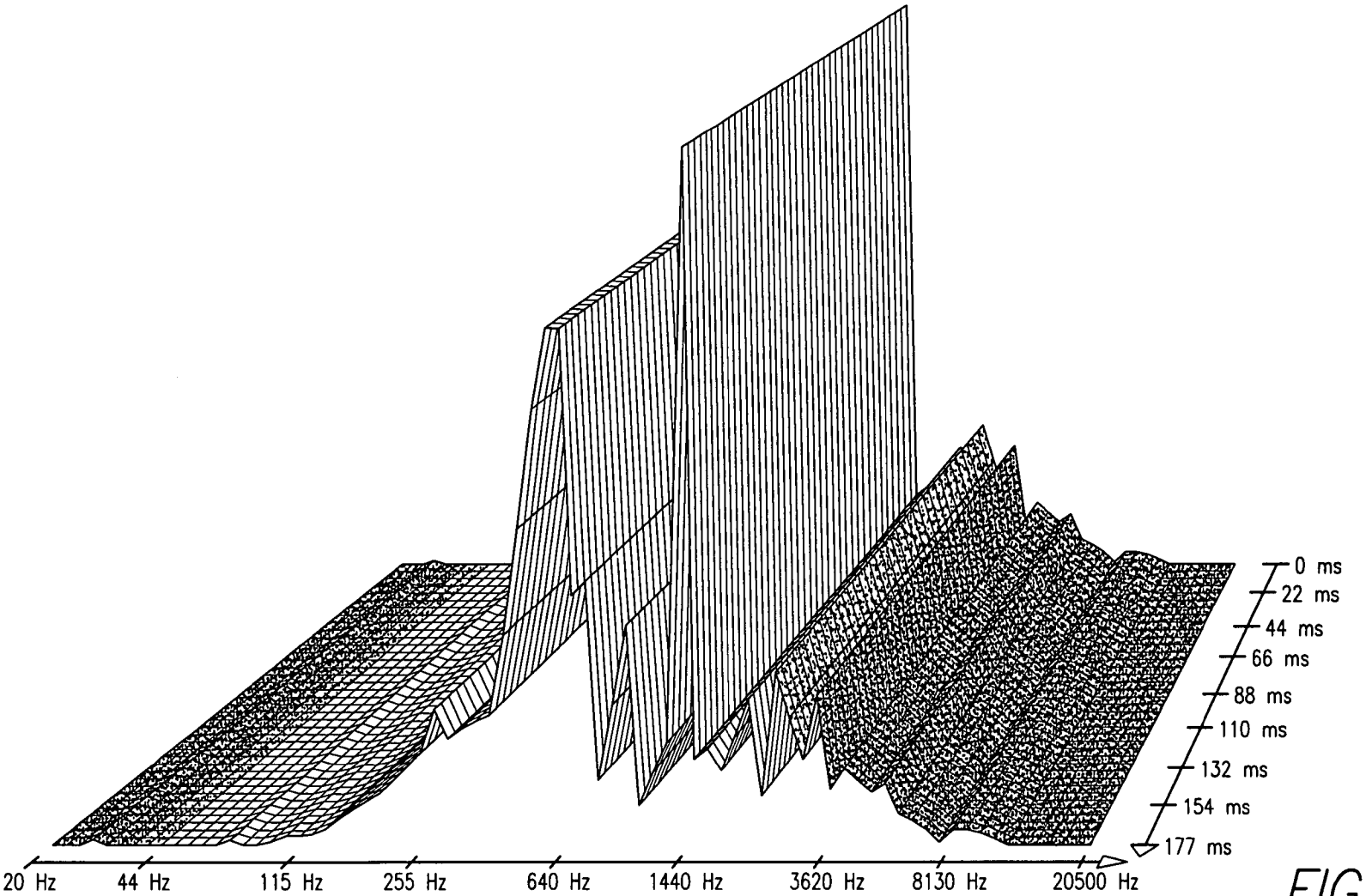
FIG. 10 is a chart depicting sound length in seconds and volume level in decibels for an embodiment of the present invention with a plug installed.

Thus, FIG. 10 illustrates the frequencies produced when stopper 34 is installed on drum body 11 and the majority of the sounds emanate from the higher harmonics of drumhead 20.

Figure 11:
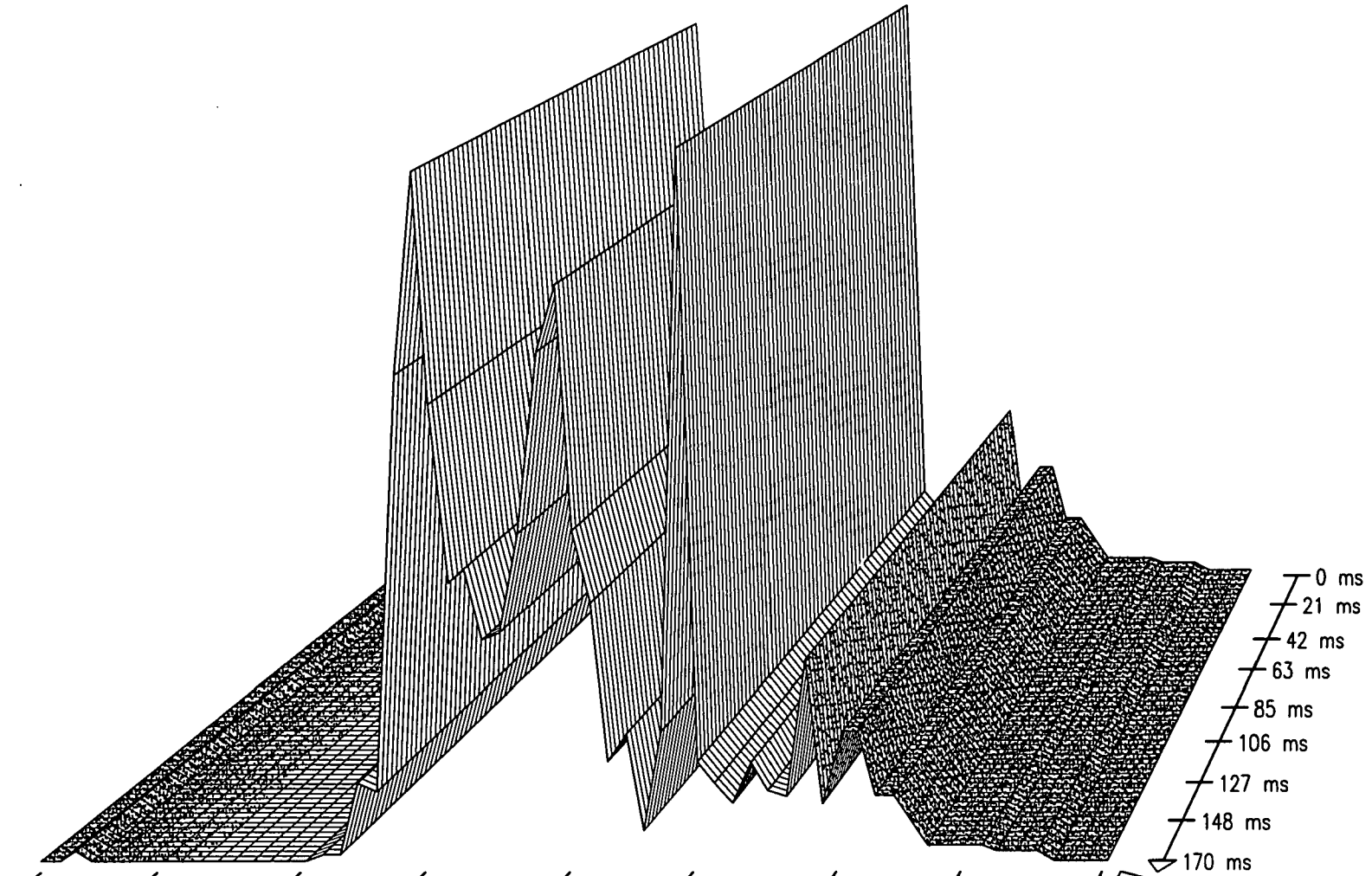
FIG. 11 is a chart depicting sound length in seconds and volume level in decibels for an embodiment of the present invention with the plug removed.

FIG. 11 illustrates the frequencies produced when stopper 34 is removed from drum body 11 and the bass or low frequency is produced, but with the majority of the sound still emanating from drumhead 20.

Figure 12:
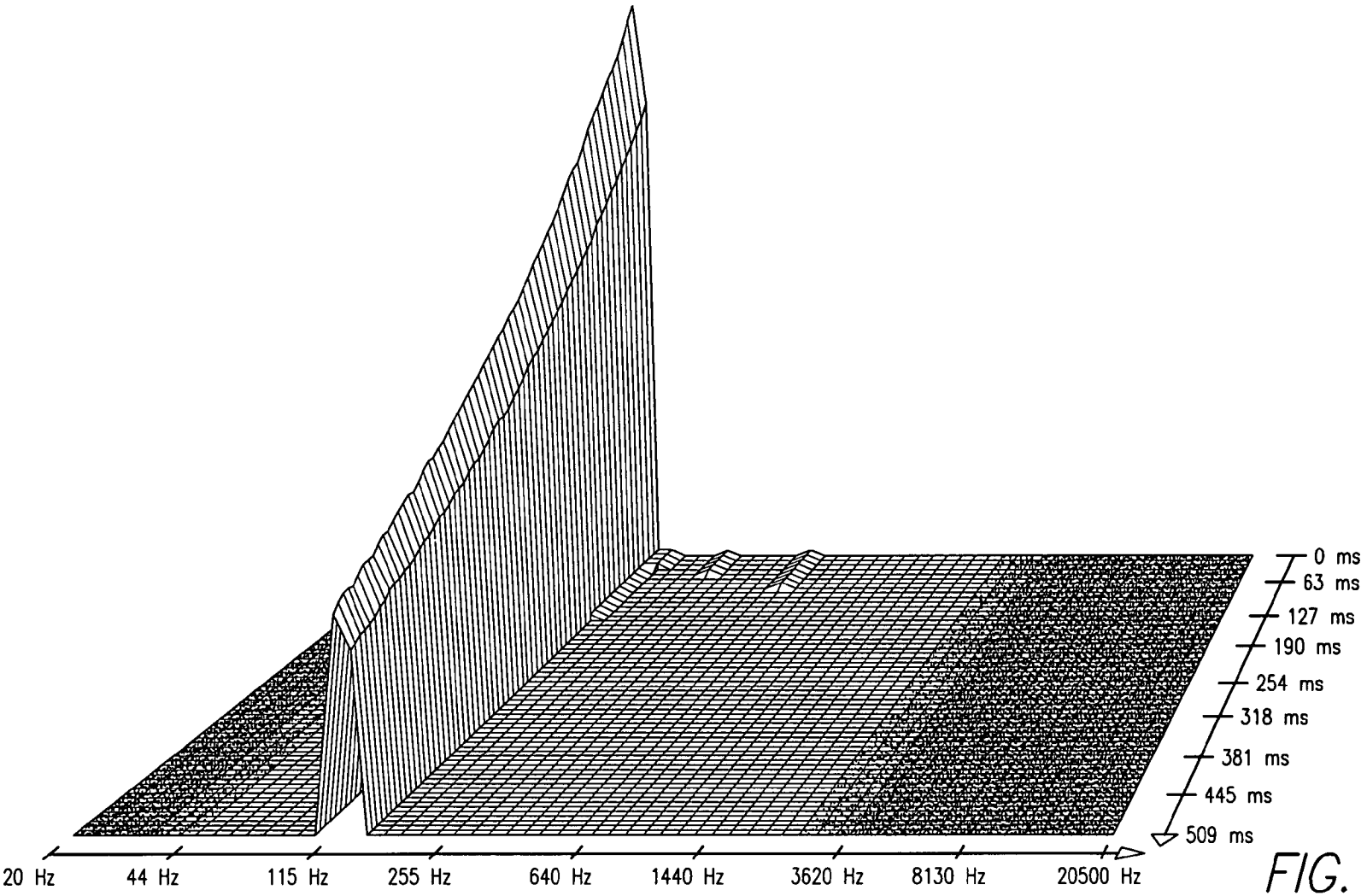
FIG. 12 is a chart depicting sound length in seconds and volume level in decibels for an embodiment of the present invention with a 6 inch tube installed.

FIG. 12 illustrates the frequencies produced when tube 26*a* (6") is installed on drum body 11 and there is an increase in bass (or low) sounds and a proportionate decrease in sounds in the higher range emanating from drumhead 20.

Figure 13:
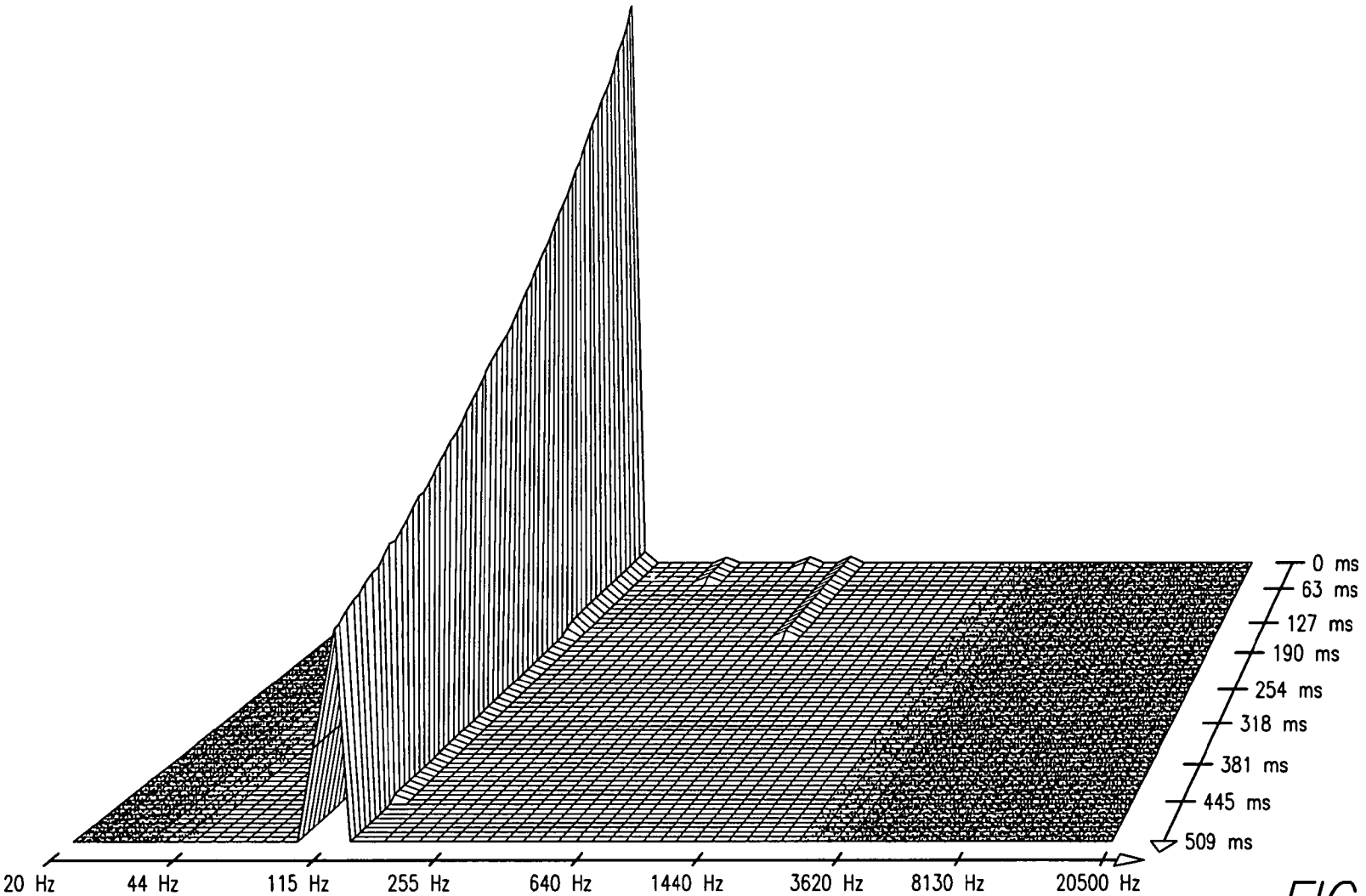
FIG. 13 is a chart depicting sound length in seconds and volume level in decibels for an embodiment of the present invention with an 8 inch tube installed.

FIG. 13 illustrates the frequencies produced when tube 26*b* (8") is installed on drum body 11 and there is a further increase in bass (or low) sounds and a proportionately greater decrease in sounds in the higher range emanating from drumhead 20.

Figure 14:
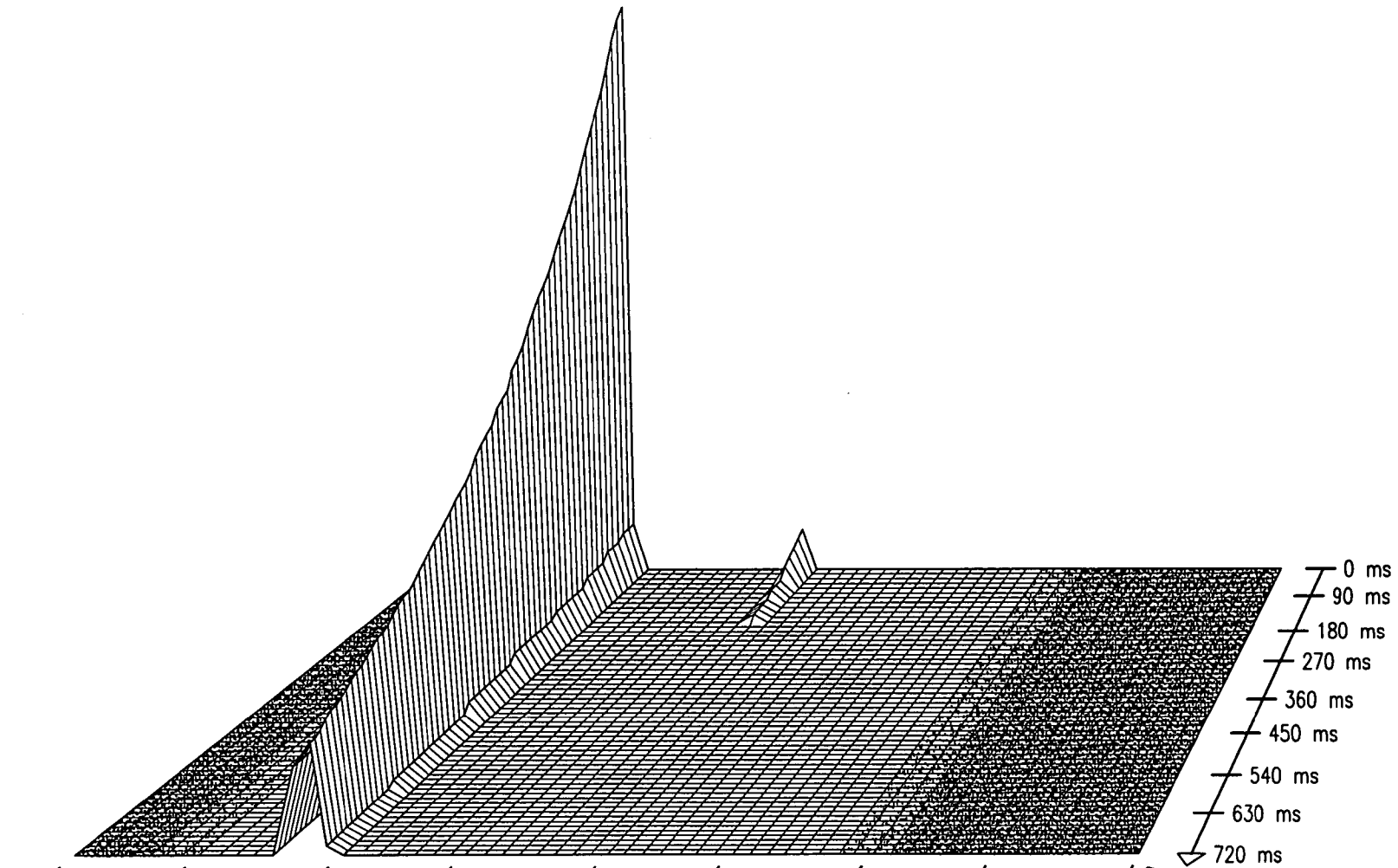
FIG. 14 is a chart depicting sound length in seconds and volume level in decibels for an embodiment of the present invention with a 14 inch tube installed.
Figure 15:
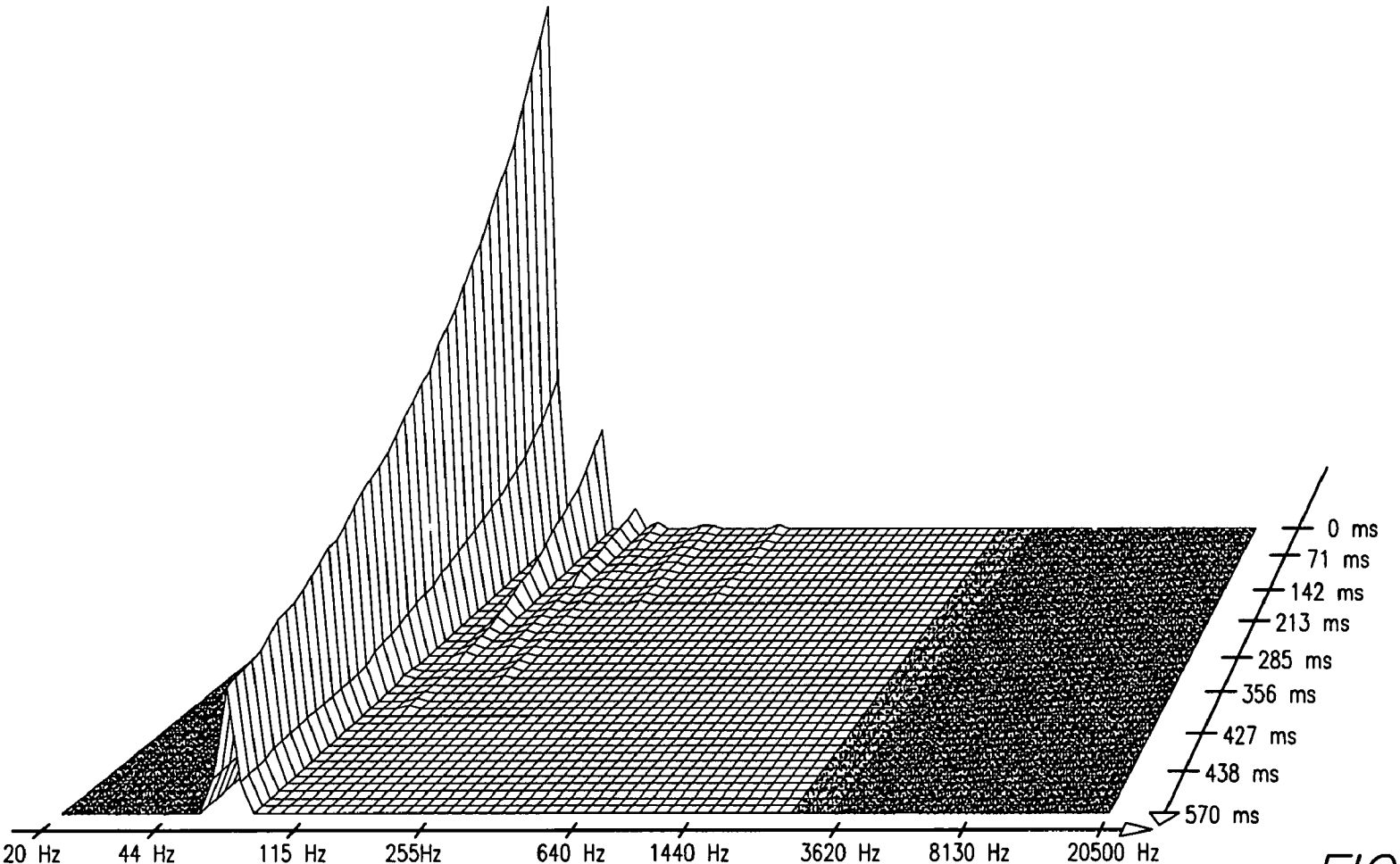
FIG. 15 is a chart depicting sound length in seconds and volume level in decibels for the embodiment of the present invention shown in FIG. 7 with the tube removed and an 8 inch opening exposed.

FIG. 14 illustrates the frequencies produced when tube 26*c* (14") is installed on drum body 11 and there is even a greater increase in bass (or low) sounds and a proportionately greater decrease in sounds in the higher range emanating from drumhead 20.

Figure 8A:
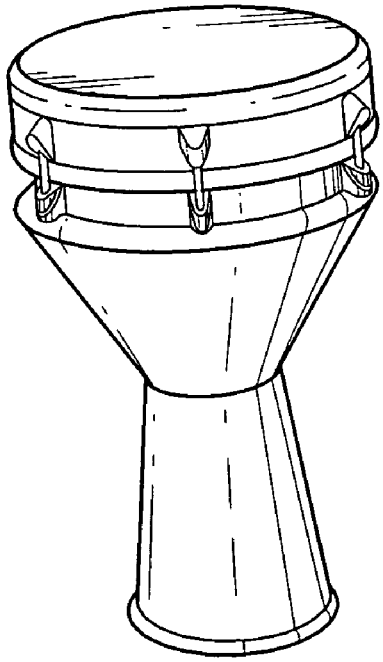
FIG. 8A is a perspective view of a prior art musical instrument comprising an African Djembe.
Figure 8B:
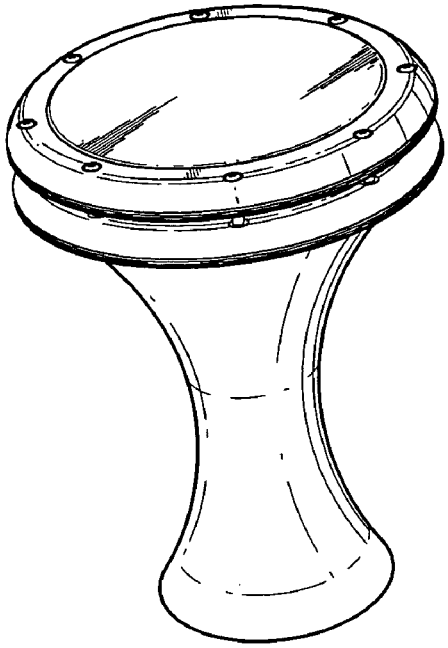
FIG. 8B is a perspective view of a prior art musical instrument comprising a Middle Eastern Doumbek.
Figure 8C:
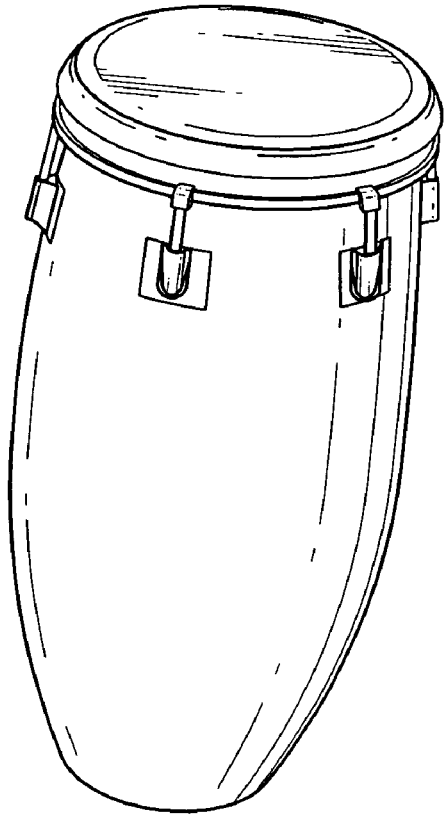
FIG. 8C is a perspective view of a prior art musical instrument comprising an Afro-Cuban Conga.

African Djembes (FIG. 8A), Middle-Eastern Doumbeks (FIG. 8B), Afro-Cuban Congas (FIG. 8C) and Japanese Shime Daiko drums (FIG. 8D) have a relative 10" head size within their "family" of drums. Therefore, the preferred embodiment for drum 10 of the present invention includes a 10" drumhead. Thus, drum 10 fitted with drumhead 20 of the proper thickness along with the appropriate size resonant member 26 enables the instrument to achieve authentic Doumbek, Djembe, Conga, and Shime Daiko drum sounds.

Middle-Eastern Doumbek drums are typically fitted with vibrating membranes of 0.007" thickness. This particular drumhead thickness produces the nuance tones and pitches generally associated with a quality authentic sounding Doumbek instrument. Head sizes for this drum generally range from 7"-11".

African Djembe drums are typically fitted with vibrating membranes of 0.010"-0.015" thickness. This particular drumhead thickness produces the slap, open, and bass tones generally associated with this instrument. Head sizes for these drums range from 10"-18".

Afro-Cuban Conga drums are typically fitted with vibrating membranes with a thickness between 0.025" and 0.040". This particular drumhead thickness produces the slap, open, and bass tones generally associated with this instrument. Head sizes for this instrument generally range from 10"-13".

Japanese Shime Daiko drums are typically fitted with vibrating membranes with a thickness between 0.035" and 0.060". This particular drumhead thickness produces the powerful and piercing high pitched articulate tones generally associated with this instrument. There is no air escape hole in the drum body, keeping drumhead deflection to a minimum. Head sizes for this instrument range from 8"-15".

Drum 10 with three tubes or resonant members 26, one "stopper" plug 34, and three drumheads 20 of 7 mil, 10 mil, & 40 mil in accordance with the present invention can produce authentic sounds of a Doumbek, Djembe, Conga, & Shime Daiko drum-saving investment costs, space and transportation. Thus, drum 10 of the present invention can be efficiently packaged in a box or case with dimensions of 19"×19"×6".

In contrast, an Afro-Cuban Conga drum has typical dimensions of 17"×17"×32"; the African Djembe has typical dimensions of 15"×15"×26"; the Middle-Eastern Doumbek has typical dimensions of 13"×13"×20"; and the Japanese Shime Daiko has typical dimensions of 16"×16"×9", the total requiring considerably more space and packaging than would drum 10 and all of its components in accordance with the present invention.

Weight comparisons include drum body 11, 6" tube 26*a*, 8" tube 26*b*, 14" tube 26*c* and stopper 34 (9 lbs.) versus an 11" conga (25 lbs.), 10" Djembe (13 lbs.), 9" Doumbek (9 lbs.) and a 10" Shime Daiko (10 lbs.)

Figure 16:
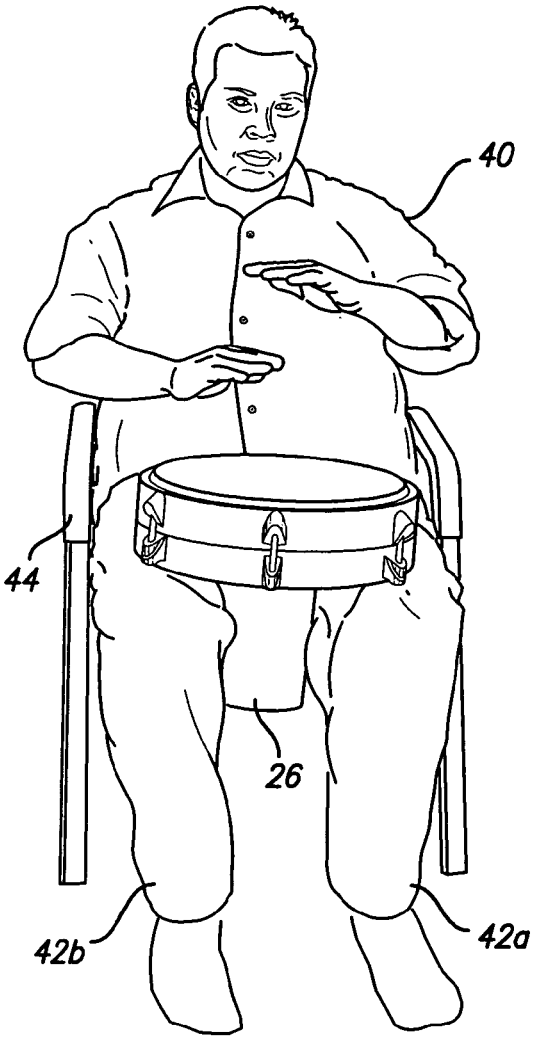
FIG. 16 shows a drum in accordance with the present invention being held between the players legs and played.
Figure 17:
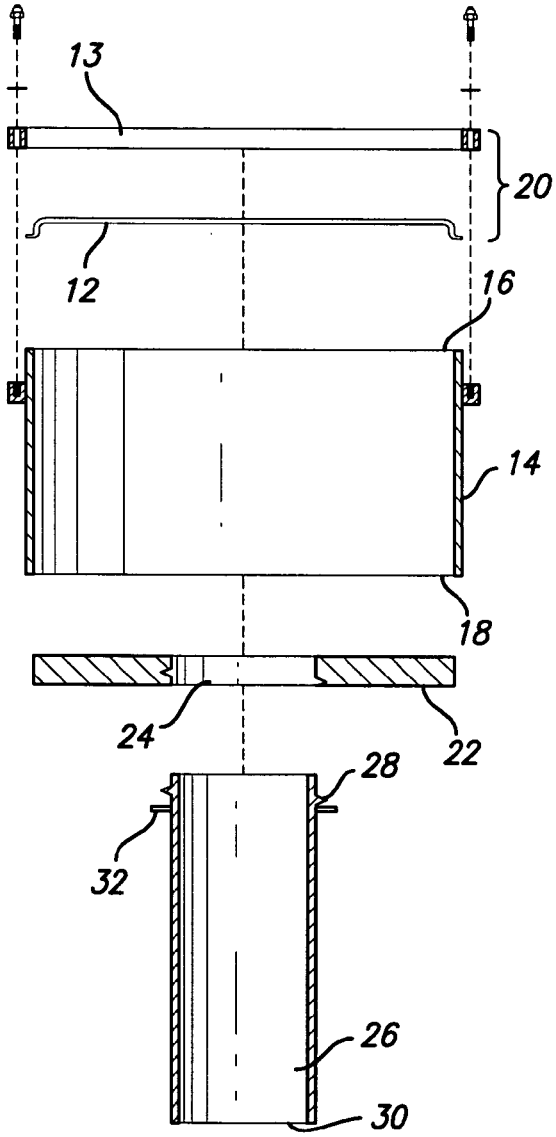
FIG. 17 is a cross-sectional exploded view of the embodiment of the present invention shown in perspective in FIG. 18.
Figure 18:
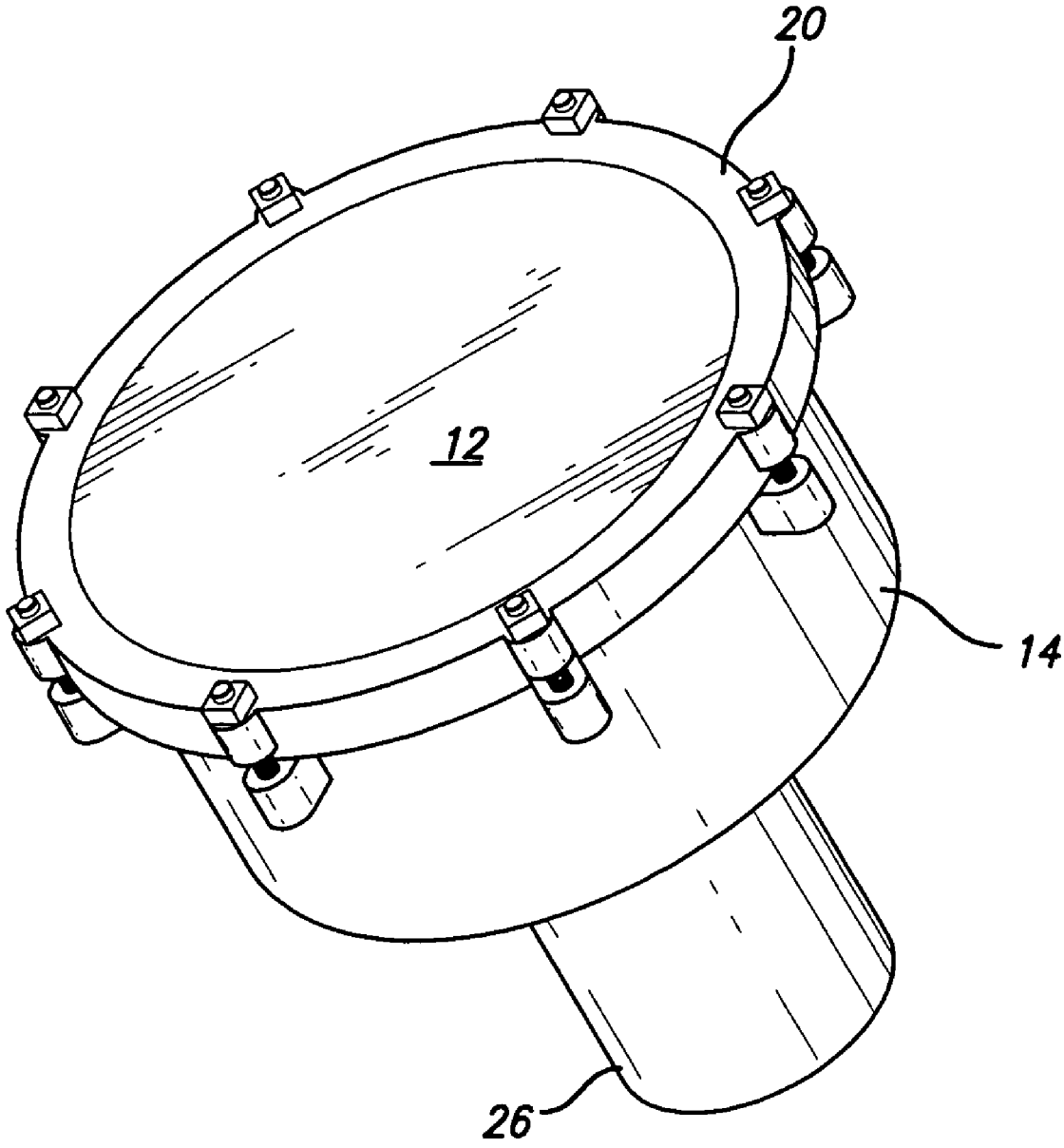
FIG. 18 is a perspective view of another embodiment of the present invention.

Having a flat bottom section on the drum body 11 allows the player 40 to simply rest drum 10 on top of the legs 42*a*, 42*b* in a seated position on a chair 44 with the resonant member 26 passing through the legs (FIG. 16). This simplistic design is extremely comfortable to play as there is no need to squeeze the legs together or employ a shoulder or neck strap to hold the instrument in place. There is also no need to tilt the drum for producing bass tones, as with a Conga drum.

While the invention will be described in connection with a certain preferred embodiment, it is to be understood that it is not intended to limit the invention to that particular embodiment. Rather, it is intended to cover all alternatives, modifications and equivalents as may be included within the spirit and scope of the invention as defined by the appended claims.

The invention claimed is:

1. A drum with a vibrating membrane for producing sounds in a range of low to high resonant frequencies, comprising:

A drum shell having a first open end and a second open end;

A drumhead having a sound vibrating membrane covering said first open end;

A cover having a threaded opening extending across and secured to said second open end;

A resonant member having a first end and a second end, said first end having a threaded means for detachable coupling with said threaded opening in said cover in airtight relation to enhance and manipulate said low resonant frequencies independent of said high resonant frequencies upon the striking of said membrane.

2. The drum of claim 1 wherein said resonant member is six inches in length.

3. The drum of claim 1 wherein said resonant member is eight inches in length.

4. The drum of claim 1 wherein said resonant member is fourteen inches in length.

5. The drum of claim 1 wherein said resonant member is four inches in diameter.

6. The drum of claim 1 wherein said first end of said resonant member includes a flange to enable and secure said airtight connection between said resonant member and said threaded opening.

7. The drum of claim 1 wherein said membrane is 0.007 inches in thickness and ranges from generally seven to eleven inches in diameter.

8. The drum of claim 1 wherein said membrane ranges from 0.010 to 0.015 inches in thickness and generally ten to eighteen inches in diameter.

9. The drum of claim 1 wherein said membrane ranges from 0.025 to 0.040 inches in thickness and generally ten to thirteen inches in diameter.

10. The drum of claim 1 wherein said membrane ranges from 0.035 to 0.060 inches in thickness and generally eight to fifteen inches in diameter.

11. The drum of claim 1 wherein said resonant member is tubular in shape.

12. The drum of claim 1 wherein said resonant member is conical in shape.

13. A percussion instrument comprising a box-like container with four side walls and a first end wall and a second end wall, said first end wall having a vibrating means and said second end wall having a threaded opening, and a resonant member having a first end and a second end, said first end having a threaded means for detachable coupling with said threaded opening in airtight relation to enhance and manipulate said low resonant frequencies independent of said high resonant frequencies upon the striking of said membrane.

14. The percussion instrument of claim 13 wherein said vibrating means comprises a thin sheet of wood.

* * * * *